US006816700B2

(12) United States Patent
Hatano

(10) Patent No.: US 6,816,700 B2
(45) Date of Patent: Nov. 9, 2004

(54) IMAGE BEARING MEMBER CLEANING APPARATUS FEATURING A ROTARY MEMBER FOR MAGNETICALLY BEARING TONER

(75) Inventor: Fukashi Hatano, Ibaraki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/358,210

(22) Filed: Feb. 5, 2003

(65) Prior Publication Data

US 2003/0152407 A1 Aug. 14, 2003

(30) Foreign Application Priority Data

Feb. 8, 2002 (JP) ..... 2002-033124

(51) Int. Cl.[7] ..... G03G 21/00; G03G 21/10
(52) U.S. Cl. ..... 399/349; 399/356; 399/358
(58) Field of Search ..... 399/343, 349, 399/350, 353, 356–358, 360

(56) References Cited

U.S. PATENT DOCUMENTS 5,376,997 A * 12/1994 Yamato et al. ..... 399/356
6,272,302 B1 * 8/2001 Yamamoto ..... 399/357 X
6,564,034 B1 * 5/2003 Abe ..... 399/350

* cited by examiner

*Primary Examiner*—William J. Royer
(74) *Attorney, Agent, or Firm*—Fitzpatrick, Cella, Harper & Scinto

(57) ABSTRACT

There is disclosed a cleaning apparatus which has a cleaning member for cleaning a surface of an image bearing member, a developer carrying member for carrying a developer cleaned by the cleaning member, a developer receiving member arranged below the cleaning member in a direction of gravity to receive the developer dropped from the cleaning member, and a developer carrying path for interconnecting the developer receiving member and the developer carrying member.

10 Claims, 7 Drawing Sheets

IMAGE BEARING MEMBER CLEANING APPARATUS FEATURING A ROTARY MEMBER FOR MAGNETICALLY BEARING TONER

BACKGROUND OF THE INVENTION

1. Field of the Invention

The present invention relates to a cleaning apparatus for removing a developer on an image bearing member, a copying machine provided with this cleaning apparatus, and an image forming apparatus such as a printer.

2. Related Background Art

Conventionally, as an image forming apparatus of this type, there has generally been used an image forming apparatus for sticking toner to an electrostatic latent image electrostatically formed on a surface of a photosensitive member as an image bearing member to form a toner image, and electrostatically transferring this toner image to a transferring material (sheet, transparent film or the like).

In such an image forming apparatus, toner remaining (residual toner) on the photosensitive member without being transferred to the transferring material in transferring must be sufficiently removed each time in order to form a next image (image formation). As its cleaning means, means for pressing a cleaning blade made of an elastic material such as urethane rubber into contact with the surface of the photosensitive member to remove the residual toner has been put into wide practical use.

However, from the viewpoint of prolonging a life of a high-speed machine, in the image forming apparatus using an a-Si (amorphous silicon) photosensitive member, it is necessary to remove not only the residual toner but also various foreign objects such as deposited organic materials or corona products caused by presence of high-pressure members in the apparatus which may cause deterioration of image quality if stuck to the photosensitive member. These foreign objects cannot be removed completely only by the cleaning blade.

Therefore, in the case of the image forming apparatus using the a-Si photosensitive member and one component magnetic toner, integrally with the cleaning blade, a magnet roller may be arranged as removal assisting means in the vicinity thereof. That is, there has been used a method for removing various foreign objects in a slide-rubbing manner by using toner magnetism, collected toner and a magnetic brush formed on the magnet roller. The magnetic brush is uniformly formed by a toner coating amount regulating member.

Further, a constitution is employed where the toner coating amount regulating member and an end scraper are separately disposed and, through a gap between the two members, toner scratched off by the toner coating amount regulating member and the end scraper is smoothly sent to a waste toner carrying portion.

In addition to the foreign object removing operation, the aforementioned method has various advantages, such as prevention of so-called "blade tearing-off" which easily occurs when there is no toner at all on the surface of the photosensitive member by using the magnetic brush to supply toner little by little, and facilitation of toner removal by the blade by applying a mechanical force to the toner electrostatically stuck to the surface of photosensitive member to reduce a sticking force of the toner to the photosensitive member. The method has been effective to a certain extent in the image forming apparatus which uses only one component magnetic toner in order to obtain a black and white image.

Now, color toner in a multicolor image forming apparatus of two colors or more is usually prepared by mixing dyes or pigments in a transparent resin to make clear a color of a copy image, and it is often nonmagnetic toner. In the case of a constitution using only nonmagnetic toner including black toner, the residual toner is often removed by the aforementioned cleaning blade.

However, since control of toner concentration is not necessary for the one component magnetic toner, and a developing apparatus can be constituted to be simpler compared with two components, there have been seen examples of using it as black toner. In the case of such a constitution, if the cleaning apparatus having the magnet roller is applied, the color toner is not adsorbed by the magnet roller, which makes it impossible to prevent problems in a cleaning function.

A constitution which removes the magnet roller and depends only on the cleaning blade in order to coordinate the cleaning operation with the nonmagnetic toner is not advisable because of the aforementioned advantages of the magnet roller and a probably largest frequency of obtaining a black image.

That is, it is desired that cleaning of the nonmagnetic toner is carried out without losing the effects provided by the magnet roller in the cleaning of the magnetic toner.

Thus, when the nonmagnetic toner is actually collected in the cleaning apparatus comprising the magnet roller, first, the nonmagnetic toner is stuck to the magnetic toner on the magnet roller by the application of an electrostatic adsorbing force or van der Waals force to be removed. However, after supplying of the nonmagnetic toner to a certain extent, the toner is freed without being captured any more, and leaked to the outside. As a result, the toner may be scattered or stuck in a gap between the magnet roller to damage the cleaning function, or rubbed by the blade to be fused on the photosensitive member.

That is, while the magnetic brush formed around the magnet roller has a capturing function of nonmagnetic toner of a given amount or lower, further supplying of the nonmagnetic toner causes sudden deterioration of the capturing function.

Therefore, as one countermeasure, a method has been employed which prevents the deterioration of the cleaning function by supplying the magnetic toner to a cleaner at given intervals in accordance with a frequency of forming color images to reduce a ratio of the nonmagnetic toner.

However, according to the aforementioned conventional technology, the nonmagnetic toner is not completely bound by the magnet roller, and accumulated in a toner receiver below the magnet roller while a cleaning operation is repeated. As a result, a phenomenon called dripping occurs where the nonmagnetic toner is leaked from a toner container.

The toner scratched off by the toner coating amount regulating member is passed on the toner coating amount regulating member and guided to a waste toner carrying path, and then discharged to the outside of the machine by a waste toner carrying screw. However, while the magnetic brush of the magnet roller is rotated from the toner coating amount regulating member to a photosensitive drum, not a little nonmagnetic toner of a weak holding force is freed from the magnetic brush to be accumulated in the toner receiver. If the cleaning operation is repeated, the amount of accumulated toner only increases.

On the other hand, in the case of the magnetic toner, because of the application of a magnetic binding force, the amount of toner freed from the magnetic brush is small. Even if freed, the toner is recollected, and thus the toner accumulated in the toner receiver is never increased beyond a certain amount.

FIGS. 9, 10 and 11 show cases where toner coating amount regulating members are respectively a roller, a blade and a block. In these drawings, a reference numeral 5 denotes a magnet roller rotated in a direction of an arrow C. Similarly, a reference numeral 5*a* denotes a magnetic brush, 6 a waste toner carrying screw, 7 a cleaning blade, 8*a* a roller (toner coating amount regulating roller), 8*b* a blade (toner coating amount regulating blade), 8*c* a block (toner coating amount regulating block), 15 a photosensitive member (image bearing member, photosensitive drum) rotated in a direction of an arrow A, 25 a cleaning container, 28 a toner receiver, 29 a supporting member (also a wall member for separating the magnetic brush from a first waste toner carrying path), 32, 33 blades, and 35 the first waste toner carrying path.

In FIG. 9, if the toner coating amount regulating member is a roller 8*a*, the roller 8*a* is supported on both side walls of the cleaning container 25, and there are a blade 32 for scratching off toner scratched off by the roller 8*a*, and a blade 33 for preventing reverse flowing of the toner from the first waste toner carrying path 35 to the toner receiver 28. Besides, the supporting member 29 is present between the toner receiver 28 and the first waste toner carrying path 35 to support the blade 33. Thus, the nonmagnetic toner accumulated in the toner receiver 28 is eventually leaked from a gap between the photosensitive member 15 and the cleaning container 25, causing a phenomenon called dripping.

In the cases of FIGS. 10 and 11 where the toner amount regulating members are a blade 8*b* and a block 8*c*, similarly, because of the presence of the supporting member 29 for supporting the blade 8*b* or a block 8*c* itself, dripping eventually occurs.

SUMMARY OF THE INVENTION

The present invention is a result of consideration given to the foregoing situation, and objects of the invention are to provide a cleaning apparatus capable of maintaining a stable cleaning function for a long time without any toner dripping, and an image forming apparatus.

According to a preferred embodiment for achieving the foregoing object, there is disclosed a cleaning apparatus which has cleaning means for cleaning a surface of an image bearing member, developer carrying means for carrying a developer cleaned by the cleaning means, a developer receiving member arranged below the cleaning means in a direction of gravity to receive the developer dropped from the cleaning means, and a developer carrying path for interconnecting the developer receiving member and the developer carrying means.

According to another preferred embodiment, there is provided an image forming apparatus which has image forming means for forming an image on an image bearing member by a developer, transferring means for transferring a developer image on the image bearing member to a transferring medium, cleaning means for cleaning a surface of the image bearing member after the transferring, developer carrying means for carrying a developer cleaned by the cleaning means, a developer receiving member arranged below the cleaning means in a direction of gravity to receive the developer dropped from the cleaning means, and a developer carrying path for interconnecting the developer receiving member and the developer carrying means.

According to these embodiments, the accumulation of developers dropped from the cleaning means to the developer receiver is prevented, and thus it is possible to limit dripping of the developers from the cleaning portion to a minimum.

DETAILED DESCRIPTION OF THE EMBODIMENTS

Figure 1:
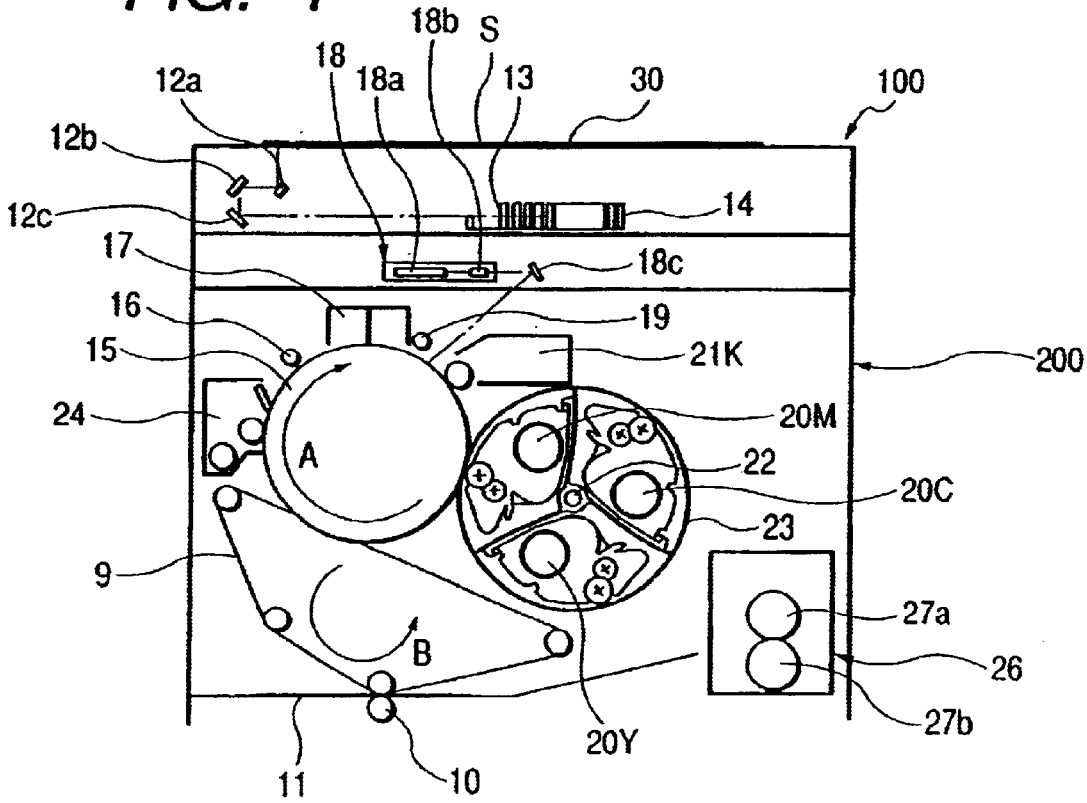
FIG. 1 is a vertical sectional view schematically showing a constitution of an image forming apparatus of the present invention.

Next, the preferred embodiments of the present invention will be described with reference to the accompanying drawings. Portions denoted by similar reference numerals in the drawings denote similar components and functions, and repeated explanation thereof will be omitted as occasion demands.

Embodiment 1

An example of an image forming apparatus of the present invention will be described by referring to FIGS. 1 to 8. However, it should be understood that the scope of the present invention is not limited to dimensions, materials, shapes, relative arrangements thereof and the like, unless specified otherwise.

The image forming apparatus shown in FIG. 1 is a color image forming apparatus of an electrophotographic system which can form full-color images of four colors, i.e., magenta (M), yellow (Y), cyan (C) and black (K). This image forming apparatus comprises a drum type electrophotographic photosensitive member (referred to as "photosensitive drum", hereinafter) 15. An electrostatic latent image is formed on the photosensitive drum 15, toner is stuck to the electrostatic latent image to develop the image, and the developed toner image is transferred to a transferring material (e.g., sheet or transparent film), whereby a full-color image is formed.

An image reading portion 100 is installed in the upper part of an image forming apparatus main body. At the image reading portion 100, an original S placed on an original glass base 30 is exposed and scanned by an exposure lamp. Accordingly, a reflected light image from the original S is converged on a full-color sensor 14 by mirrors 12*a*, 12*b* and 12*c* and a lens 13 to obtain a color separation image signal.

The color separation image signal is passed through an amplifier circuit (not shown), processed by a video processing unit (not shown), and sent out to an image forming portion 200. At the image forming portion 200, when a signal of an image forming state is entered, the photosensitive drum 15 which is an image bearing member is first rotary-driven in an direction of an arrow A by driving means (not shown). Around the photosensitive drum 15, there are arranged a pre-exposure lamp 16, a corona electrifier 17, a laser exposure optical system 18 which is exposing means, a potential sensor 19, a cleaning apparatus (cleaner) 24, a fixed black developing device 21K, three rotatable color developing devices 20M, 20Y and 20C, and an intermediate transferring member (intermediate transferring belt) 9. The developing devices 20M, 20Y and 20C perform development in this order by toner of magenta, yellow and cyan. Incidentally, the color developing devices 20M, 20Y and 20C use nonmagnetic toner, while the black developing device 21K uses magnetic toner.

In the laser exposure optical system 18, the image signal from the image reading portion 100 is converted into an optical signal at a laser output portion (not shown), the converted laser beam is reflected on a rotary polygon mirror 18*a*, and projected through a lens 18*b* and a mirror 18*c* to the surface (outer peripheral surface) of the photosensitive drum 15. In image formation, the photosensitive drum 15 is rotated in the direction of the arrow A, the photosensitive drum 15 discharged by the pre-exposure lamp 16' is uniformly charged to a predetermined polarity/potential by the corona electrifier 17, and the optical image is subjected to irradiation for each separation color, whereby an electrostatic latent image is formed.

Each of the color developing devices 20M, 20Y and 20C is detachably held by a developing rotary 23 rotated around a rotary shaft 22. In image formation, each developing device 20M, 20Y and 20C is rotated and moved around the rotary shaft 22 in the state of being held by the developing rotary 23, and the developing device 20M, 20Y and 20C used for development is stopped in a developing position opposite the photosensitive drum 15. Further, after a developing sleeve is positioned to face the photosensitive drum 15 by a very small gap, toner is stuck corresponding to the electrostatic latent image of the photosensitive drum 15 to develop a toner image.

In color image formation, the developing rotary 23 is rotated for each rotation of the intermediate transferring member 9 in a direction of an arrow B, and a developing process is carried out for the magenta developing device 20M, the yellow developing device 20Y, the cyan developing device 20C and the black developing device 21K in this order.

The toner image made visible by each developing device 20M, 20Y and 20C on the photosensitive drum 15 is multi-transferred (primary transfer) four times (each image of four colors M, Y, C and K). Accordingly, the intermediate transferring member 9 is rotated in the direction of the arrow B in synchronization with an outer peripheral velocity of the photosensitive drum 15. Incidentally, for the photosensitive drum 15 after the primary transfer of the toner image, toner remaining (residual toner) on the surface of the photosensitive drum 15 without being transferred to the intermediate transferring member 9 is removed by the cleaning apparatus 24 for each primary transfer of the toner image of each color, and the photosensitive drum 15 is thereby set ready for forming a toner image of a next color.

The intermediate transferring member 9 to which the toner image has been multi-transferred holds a transferring material 11 between itself and a transferring roller 10 (secondary transferring roller) 10, and conveys it. Thus, the transferring material 11 receives simultaneous multi-transfer of the toner images of the respective colors on the intermediate transferring member 9, and then it is conveyed toward a fixing apparatus 26 for carrying out fixing of a next process.

The transferring material 11 holding the toner image on the surface conveyed to the fixing apparatus 26 is conveyed by a fixing roller 27*a* and a pressure roller 27*b*, heated and pressurized, whereby the toner image is fixed on the surface. After the toner image fixing, the transferring material 11 is discharged to the outside of the image forming apparatus main body. Thus, the image formation of the full-color images of the four colors is finished.

Figure 2:
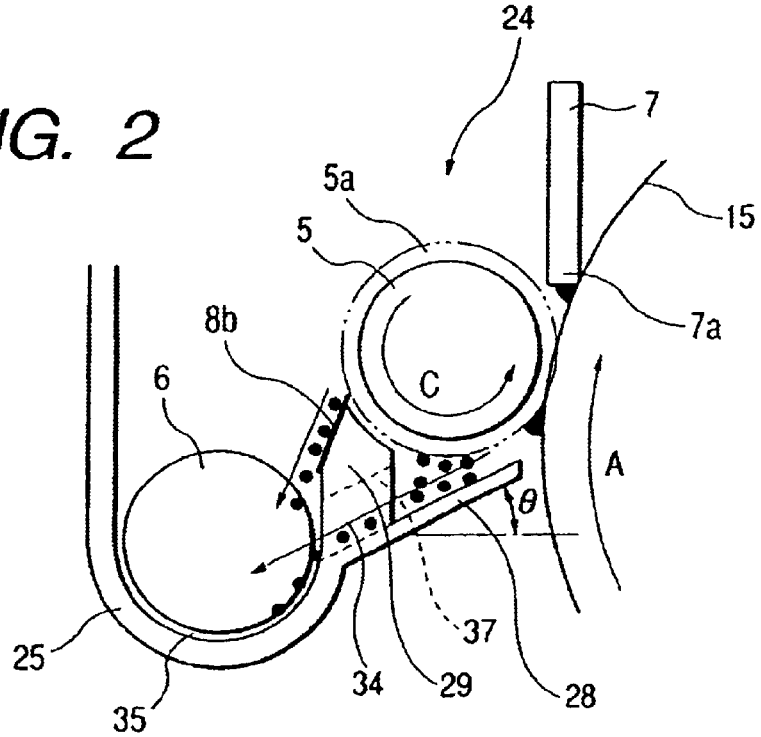
FIG. 2 is an enlarged vertical sectional view of a cleaning apparatus.

FIG. 2 is an enlarged explanatory view of the cleaning apparatus 24.

The reference numeral 8*b* in the drawing is a blade-shaped toner coating amount regulating member made of a nonmagnetic material. For example, it is constituted of a nonmagnetic metal blade (stainless or the like). The reference numeral 6 denotes a waste toner carrying screw (waste toner carrying means).

A cleaning blade 7 which base end side (upper end side in FIG. 2) is fixed to a part (not shown) of a cleaning container 25 presses one edge 7*a* of its tip side (lower end side in FIG. 2) into contact with the surface of the photosensitive drum 15, and scratches off residual toner left on the surface of the photosensitive drum 15 after transfer. The cleaning blade 7 is made of, for example a material having elasticity. For example, it may be made of urethane rubber or the like. A magnet roller 5 is arranged on the upstream side of the cleaning blade 7 seen from a moving direction (direction of the arrow A) of the surface of the photosensitive drum 15. The magnet roller 5 is rotary-driven in a direction of an arrow C, and its surface is moved in the same direction as the moving direction (direction of the arrow A) of the surface of the photosensitive drum 15. As the magnetic toner and the nonmagnetic toner are supplied by the developing devices 20M, 20Y, 20C and 21K, a part of the collected magnetic toner (referred to as collected toner hereinafter as occasion demands) forms a magnetic brush 5*a* which is a toner layer of a certain thickness decided by the toner coating amount regulating member 8*b* on the surface of the magnet roller 5.

The toner coating amount regulating member 8*b* is arranged so that a thickness of the formed toner layer can be properly set larger than a minimum gap between the photosensitive drum 15 and the magnet roller 5. The toner layer reaches a position opposite the photosensitive drum 15 following rotation of the magnet roller 5 to carry out sure slide-rubbing on the surface of the photosensitive drum 15. The collected toner scratched off by the toner coating amount regulating member 8*b* is passed on the toner coating amount regulating member 8*b* and guided to a first waste toner carrying path 35. It is then carried in an axial direction by rotation of the waste toner carrying screw 6, and discharged to the outside.

The toner (mainly nonmagnetic toner) broken away while the magnetic brush 5*a* of the magnet roller 5 is rotated from the toner coating amount regulating member 8*b* to the photosensitive drum 15 drops onto a toner receiver 28 below the magnet roller 5. The toner receiver 28 has an inclination descending from the magnet roller 5 toward the first waste toner carrying path 35, and the nonmagnetic toner dropped to the toner receiver 28 is carried toward the first waste toner carrying path 35 by its own weight. Incidentally, toner carrying of the toner receiver 28 by its own weight can be effectively carried out by an inclination of about 20° from a horizontal direction as indicated by θ in FIG. 2.

Between the toner receiver 28 and the first waste toner carrying path 35, a supporting member 29 is disposed to project upward. This supporting member 29 supports the aforementioned toner coating amount regulating member 8*b* on its upper surface, and its lower part is supported by a plurality of toner reverse-flow preventing blades (beam portion) 34. The supporting member 29 is also a wall member for separating the toner receiver 28 from the first waste toner carrying path 35.

Figure 3:
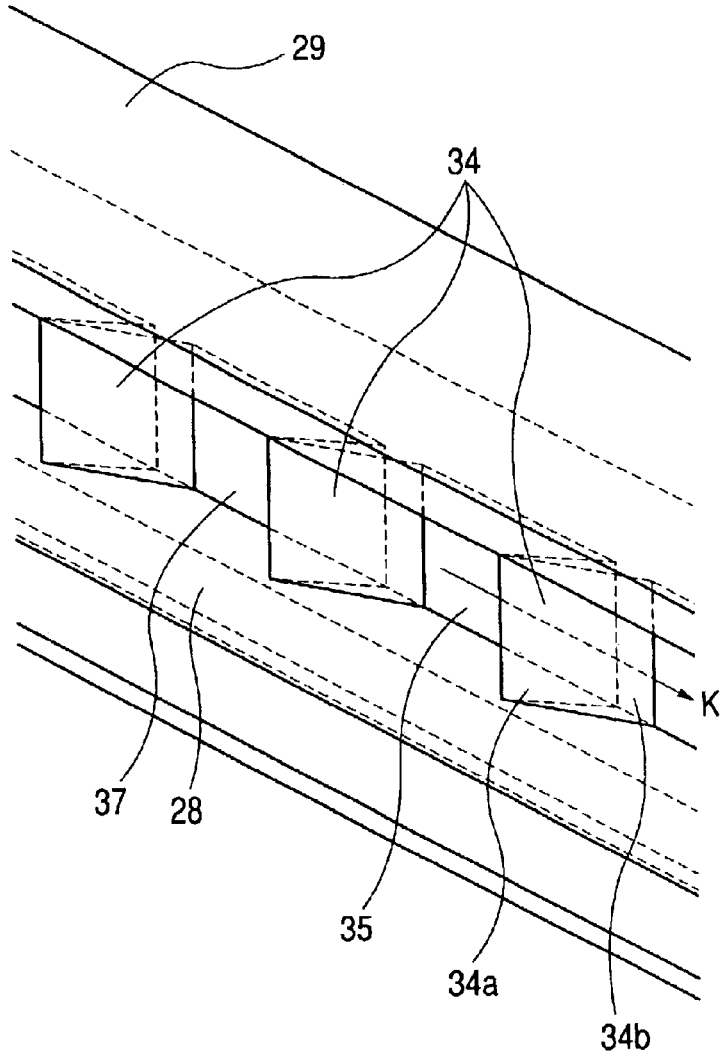
FIG. 3 is a perspective view seen from a toner reception side explaining a second waste toner carrying path.
Figure 4:
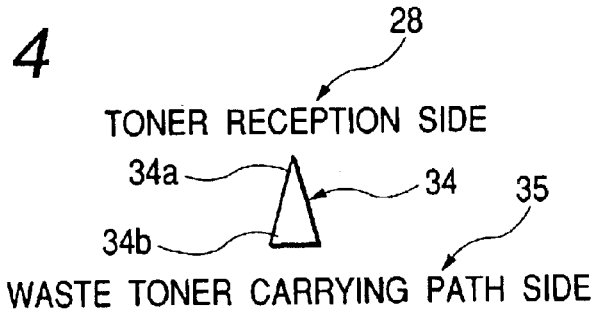
FIG. 4 is a view showing a shape of a surface of a beam portion for forming the second waste toner carrying path, which is parallel to a toner receiver.

The plurality of toner reverse-flow preventing blades 34 form a ladder-shaped second waste toner carrying path 37 between the toner receiver 28 and the first waste toner carrying path 35. As shown in FIG. 3, the toner reverse-flow preventing blades 34 are constituted of members having a wedge sectional shape (sectional shape parallel to the toner receiver 28) along a toner moving direction, and the plurality thereof are mounted in left and right directions (axial direction of the magnet roller 5). In the toner reverse-flow preventing blades 34, as shown in FIG. 4, a sharp tip 34*a* is directed to the toner receiver side, and a wider base end 34*b* is directed to the first waste toner carrying path side. Further, the toner reverse-flow preventing blades 34 may be mounted by being inclined in a direction perpendicular to a moving direction (direction of an arrow K in FIG. 3) of toner carried in the first waste toner carrying path 35. That is, when seen from the direction of the arrow K, the toner reverse-flow preventing blades 34 are inclined so that the base end 34*b* is positioned on the downstream side and the tip 34*a* is positioned on the upstream side. The second waste toner carrying path 37 is formed between the adjacent toner reverse-flow preventing blades 34, and the nonmagnetic toner carried from the toner receiver 28 by its own weight is smoothly moved to the first waste toner carrying path 35 without being blocked by the toner reverse-flow preventing blades 34 because of the wedge shape of the toner-reverse flow preventing blades 34. Further, for the nonmagnetic toner which has passed through the toner reverse-flow preventing blades 34 and entered the first waste toner carrying path 35, since the toner reverse-flow preventing blades 34 are mounted by being inclined as described above, it is difficult to move from the first waste toner carrying path 35 to the toner receiver 28 side in the process of being carried in the direction of the arrow K by the waste toner carrying screw 6.

Figure 5:
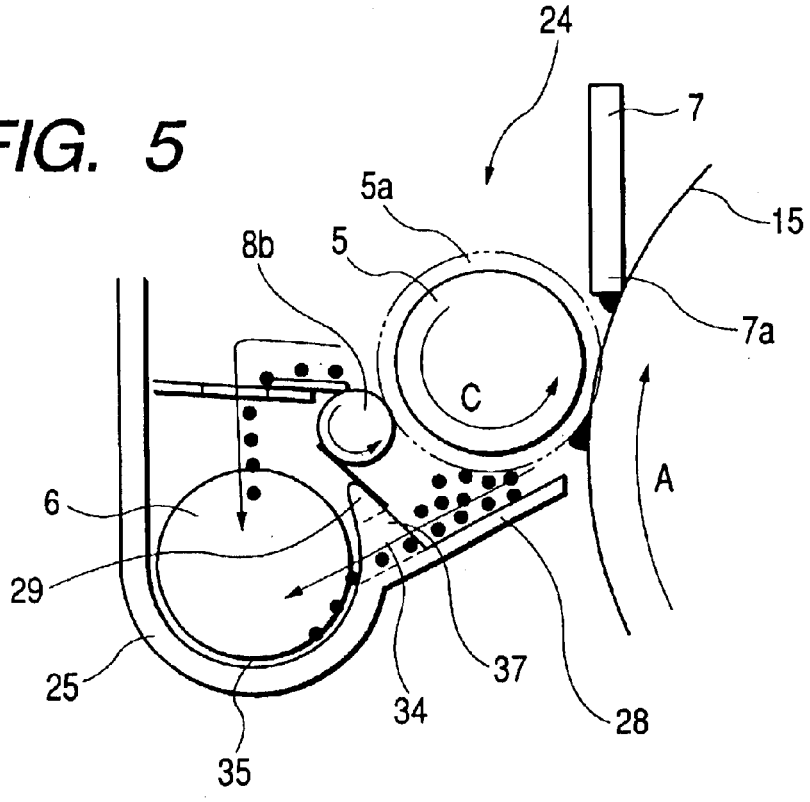
FIG. 5 is a view showing another type of a toner coating amount regulating member.
Figure 6:
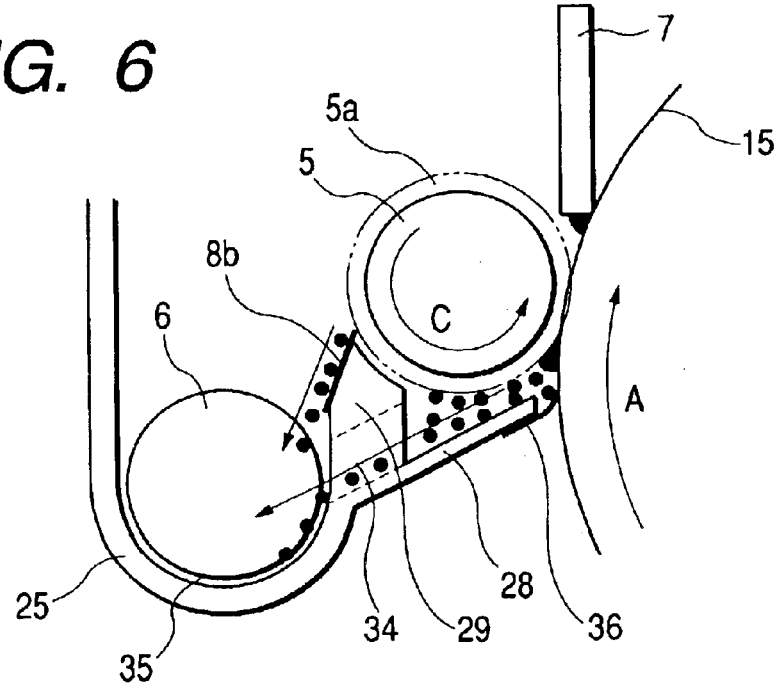
FIG. 6 is a view showing a sheet material disposed at a tip of the toner receiver and brought into contact with a surface of a photosensitive drum.

Additionally, as shown in FIG. 5, if the toner coating amount regulating member 8*a* is a roller, by providing the inclination of the toner receiver 28 and the second waste toner carrying path 37, even when the toner reversely flows from the first waste toner carrying path 35 toward the toner receiver 28, the toner is carried again to the first waste toner carrying path 35. Accordingly, the toner reverse-flow preventing blades 34 are not always necessary. However, preferably, the toner reverse-flow preventing blade 34 is disposed because such reverse-flowing toner has a direct effect on the magnetic brush 5*a*.

Further, by loading a sheet material 36 such as a urethane sheet from the toner receiver 28 on the photosensitive drum 15, it is possible to completely prevent dripping of toner from the cleaning container 25. This sheet material 36 is constituted of, for example a resin sheet of polyethylene terephthalate (PET) or urethane.

Furthermore, when the waste toner is discharged to the outside of the machine by the waste toner carrying screw 6, depending on a winding direction and a rotational direction of the waste toner carrying screw 6, there are a case where the waste toner is carried by being pressed to the outlet side of the second waste toner carrying path 37 and a case where the waste toner is carried by being pressed to the wall of the cleaning container 25 of the opposite side. If the amount of waste toner is large, when the waste toner is carried by being pressed to the outlet side of the second waste toner carrying path 37, there is a possibility of closing of the outlet by the waste toner or its reverse-flowing.

Figure 7:
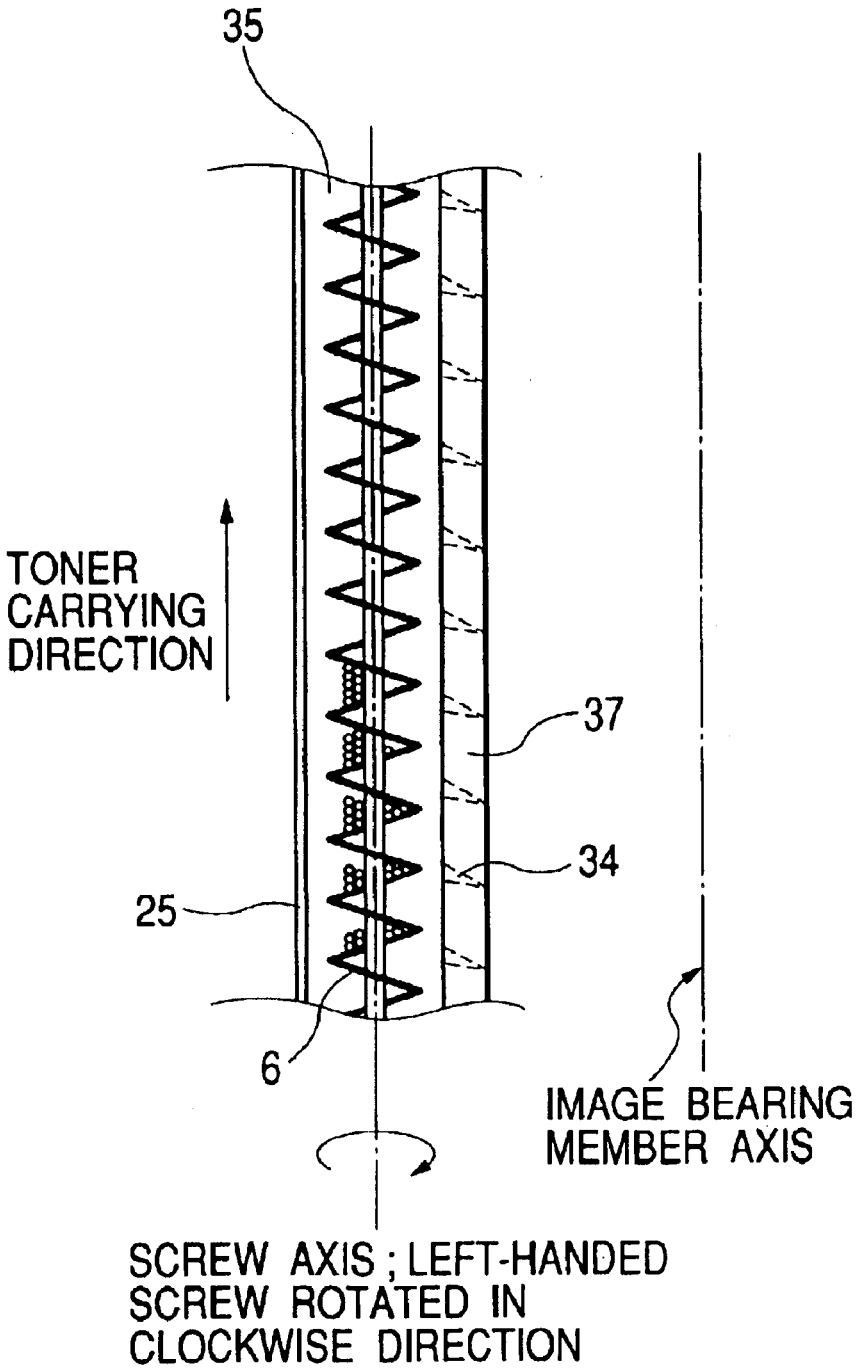
FIG. 7 is a view showing a toner carrying screw and its rotational direction.
Figure 8:
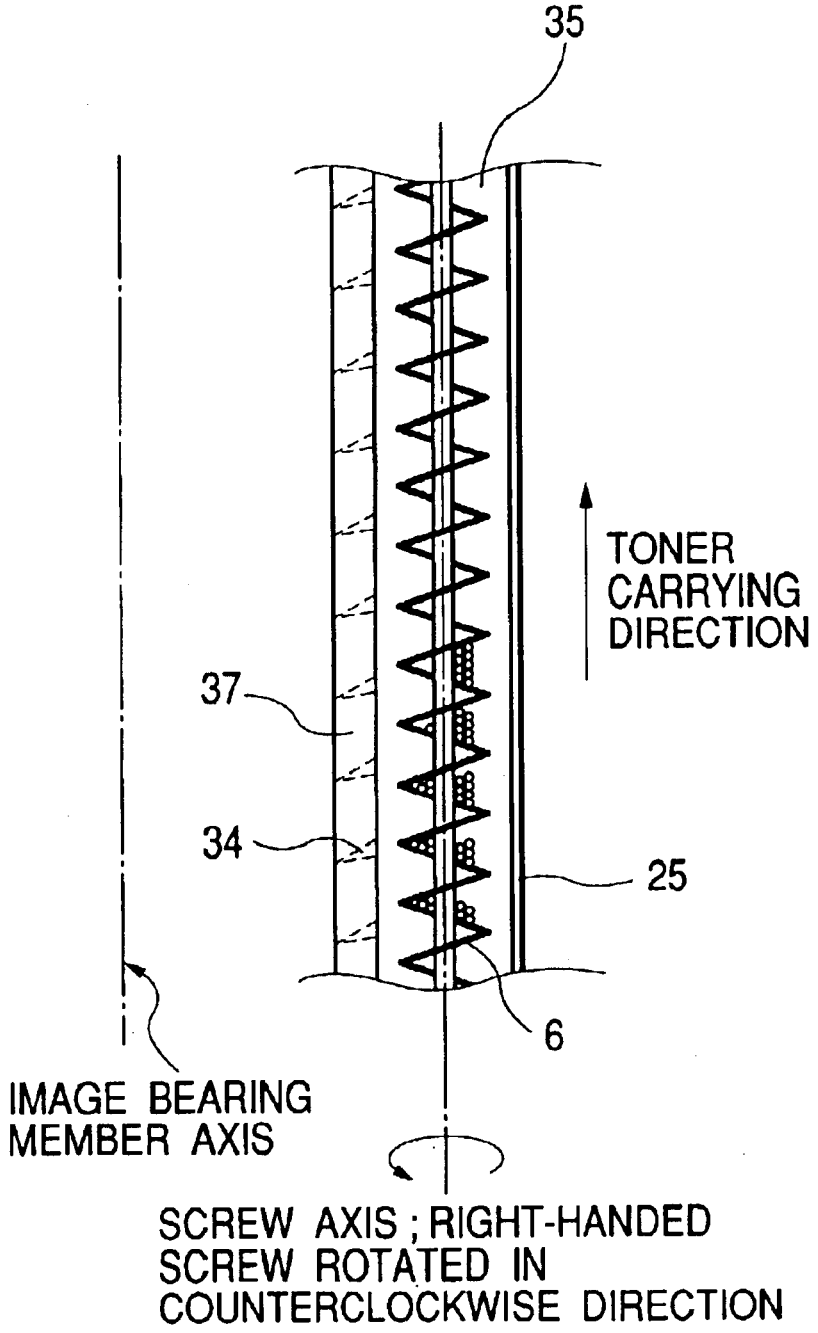
FIG. 8 is a view showing a toner carrying screw and its rotational direction in the case of another apparatus arrangement.
Figure 9:
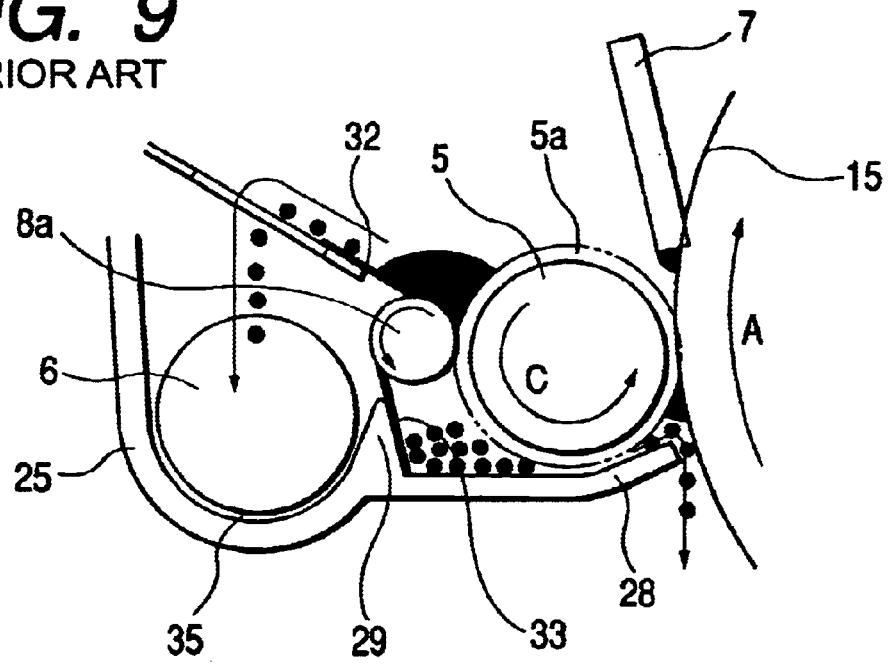
FIG. 9 PRIOR ART
FIG. 9 is a vertical sectional view showing a constitution of a conventional cleaner where a toner coating amount regulating member is a roller-shaped member.
Figure 10:
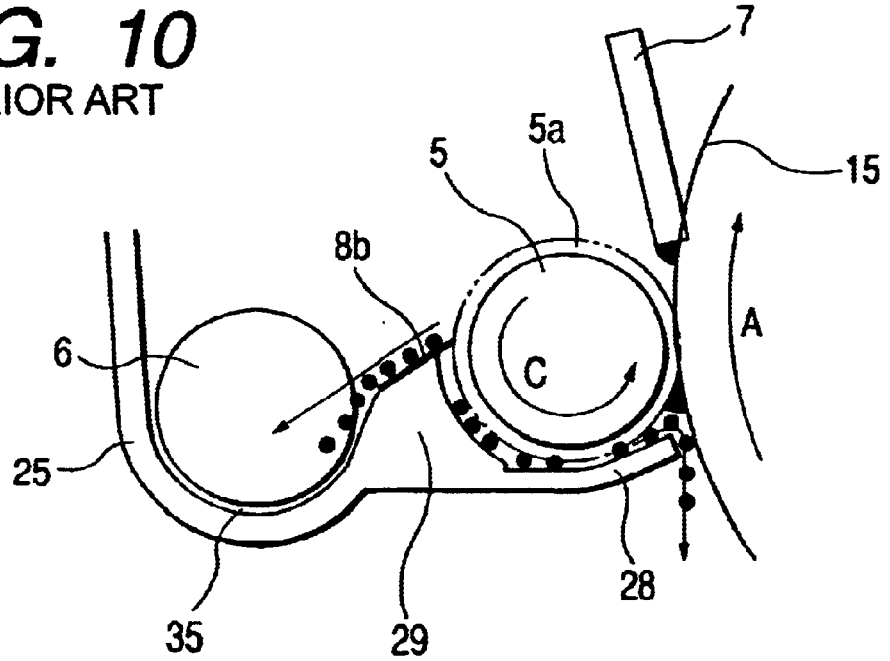
FIG. 10 PRIOR ART
FIG. 10 is a vertical sectional view showing a constitution of a conventional cleaner where a toner coating amount regulating member is a blade-shaped member.
Figure 11:
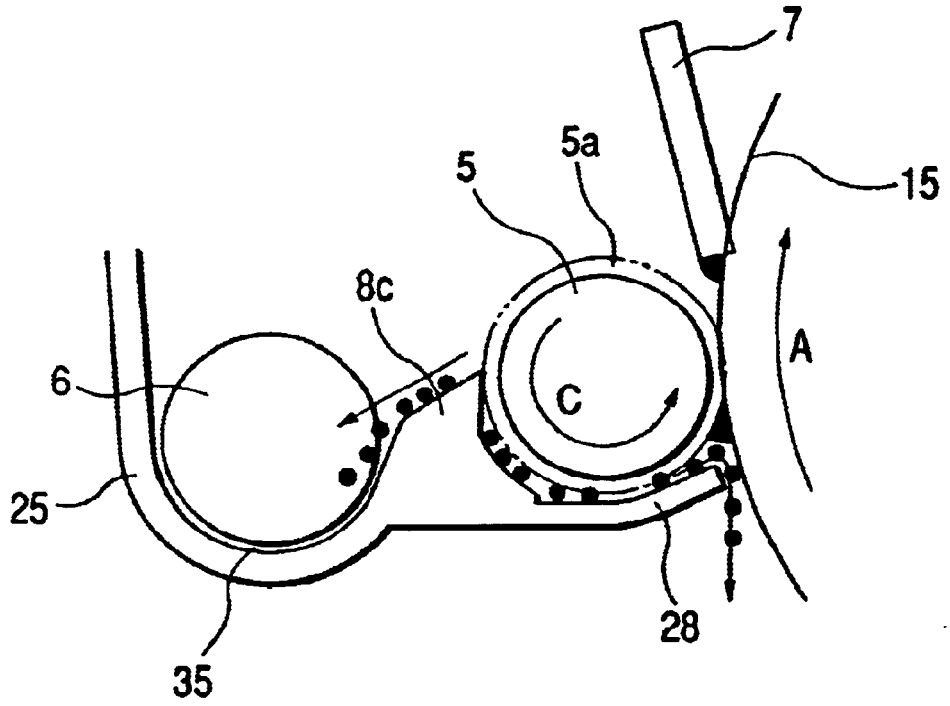
FIG. 11 PRIOR ART
FIG. 11 is a vertical sectional view showing a constitution of a cleaner where a toner coating amount regulating member is a block-shaped member.

Thus, if the cleaning apparatus 24 is arranged to the left of the photosensitive drum 15 as in the embodiment shown in FIGS. 1 and 2, as shown in FIG. 7, the waste toner carrying screw 6 is wound counterclockwise, and its rotational direction is clockwise. On the other hand, if the cleaning apparatus 24 is arranged to the right of the photosensitive drum 15 (not shown), as shown in FIG. 8, the waste toner carrying screw 6 is wound clockwise, and its rotational direction is counterclockwise. According to this constitution, since the carried toner approaches a side opposite the outlet of the second waste toner carrying path 37 by the carrying operation of the screw, the waste toner can be discharged to the outside of the machine without closing the outlet of the second waste toner carrying path 37, and without any reverse-flowing from the second waste toner carrying path.

The embodiment has been described by way of example where the toner coating amount regulating member is blade-shaped. However, while the foregoing basic constitution is maintained, a roller-shaped or block-shaped toner coating amount regulating member can be used. In this case, effects similar to the foregoing can be obtained. However, in the case of the block-shaped member 29, the member itself is equivalent to the supporting member of the embodiment.

What is claimed is:

1. A cleaning apparatus for cleaning an image bearing member comprising:

a rotary member, which magnetically bears toner and rotates, said rotary member being disposed so as to face the image bearing member;

a toner receiving portion for receiving toner dropped from said rotary member, said toner receiving portion being disposed below said rotary member;

carrying means for carrying toner removed from the image bearing member;

a regulating member for regulating a thickness of a layer of toner borne by said rotary member; and a supporting portion for supporting said regulating member between said rotary member and said carrying means, wherein said supporting portion is provided with an opening portion for constituting a toner carrying path inclined downward from said toner receiving portion toward said carrying means.

2. A cleaning apparatus according to claim 1, wherein said cleaning apparatus removes magnetic toner and nonmagnetic toner from the image bearing member.

3. A cleaning apparatus according to claim 1, wherein said opening portion includes a plurality of opening portions provided in a longitudinal direction of said supporting portion.

4. A cleaning apparatus according to claim 1, wherein said supporting portion includes a toner reverse-flow preventing mechanism for preventing toner from reversably flowing toward said toner receiving portion.

5. A cleaning apparatus according to claim 1, wherein said toner carrying path is disposed so as to be inclined in a downward direction so that an angle of inclination of said toner carrying path is equal to or greater than 20 degrees with respect to a horizontal direction.

6. A cleaning apparatus according to claim 1, wherein said regulating member includes a blade.

7. A cleaning apparatus according to claim 1, wherein said carrying means carries toner in an axial direction of said rotary member.

8. A cleaning apparatus according to claim 1, further comprising a blade for removing toner from the image bearing member at an edge portion abutting against the image bearing member, wherein said rotary member rotates in a direction of supplying toner to said edge portion.

9. A cleaning apparatus for cleaning an image bearing member comprising:

a rotary member, which magnetically bears toner and rotates, said rotary member being disposed so as to face the image bearing member;

a toner receiving portion for receiving toner dropped from said rotary member, said toner receiving portion being disposed below said rotary member;

carrying means for carrying toner removed from the image bearing member; and a reverse-flow preventing portion for preventing toner from reversely flowing from said carrying means toward said toner receiving portion, wherein said reverse-flow preventing portion is provided with an opening portion for carrying toner from said toner receiving portion toward said carrying means.

10. A cleaning apparatus according to claim 9, further comprising a regulating rotary member for regulating a thickness of a layer of toner borne by said rotary member, and said reverse-flow preventing portion includes:

a removing member for removing toner from said regulating rotary member, and a supporting member for supporting said removing member between said toner receiving portion and said carrying means, said supporting member being provided with said opening portion.

* * * * *

UNITED STATES PATENT AND TRADEMARK OFFICE

CERTIFICATE OF CORRECTION

PATENT NO. : 6,816,700 B2
DATED : November 9, 2004
INVENTOR(S) : Fukashi Hatano

It is certified that error appears in the above-identified patent and that said Letters Patent is hereby corrected as shown below:

Column 2,
Line 26, “is” should read -- be --.

Column 5,
Line 19, “exposing” should read -- an exposing --; and
Line 47, “the” should read -- each --.

Column 7,
Line 67, “blade 34 is” should read -- blades 34 are --.

Column 8,
Line 18, “of” (second occurrence) should be deleted.

Column 10,
Line 20, “member,” should read -- member; --.

Signed and Sealed this

Nineteenth Day of April, 2005

JON W. DUDAS
*Director of the United States Patent and Trademark Office*